US009627776B2

(12) United States Patent
Laight et al.

(10) Patent No.: US 9,627,776 B2
(45) Date of Patent: Apr. 18, 2017

(54) ANTENNAS

(71) Applicant: BAE SYSTEMS plc, London (GB)

(72) Inventors: Alan James Keith Laight, Isle of Wight (GB); Jonathan James Stafford, Isle of Wight (GB); Gavin Roy Crouch, Isle of Wight (GB); Michael Andrew Scott, Isle of Wight (GB); Paul David Gilliam, Isle of Wight (GB)

(73) Assignee: BAE SYSTEMS pllc, London (GB)

( * ) Notice: Subject to any disclaimer, the term of this patent is extended or adjusted under 35 U.S.C. 154(b) by 0 days.

(21) Appl. No.: 14/651,892

(22) PCT Filed: Dec. 11, 2013

(86) PCT No.: PCT/GB2013/053259

§ 371 (c)(1),
(2) Date: Jun. 12, 2015

(87) PCT Pub. No.: WO2014/091228

PCT Pub. Date: Jun. 19, 2014

(65) Prior Publication Data

US 2015/0318623 A1 Nov. 5, 2015

(30) Foreign Application Priority Data

Dec. 14, 2012 (EP) ..... 12275204
Dec. 14, 2012 (GB) ..... 1222600.7

(51) Int. Cl.
*H01Q 21/00* (2006.01)
*H01Q 1/02* (2006.01)

(52) U.S. Cl.
CPC ..... *H01Q 21/0075* (2013.01); *H01Q 1/02* (2013.01); *H01Q 21/0087* (2013.01); *Y10T 29/49018* (2015.01)

(58) Field of Classification Search
CPC .. H01Q 21/0075; H01Q 1/02; H01Q 21/0087; Y10T 29/49018

(Continued)

(56) References Cited

U.S. PATENT DOCUMENTS 3,230,539 A * 1/1966 Schell ..... H01Q 3/443 333/161
4,973,972 A * 11/1990 Huang ..... H01Q 21/065 333/26

(Continued)

FOREIGN PATENT DOCUMENTS

| | | | |
|---|---|---|---|
| EP | 1544944 | A2 | 6/2005 |
| GB | 2171257 | A | 8/1986 |
| WO | 9009042 | | 8/1990 |
| WO | 03019723 | A1 | 3/2003 |
| WO | 2008045349 | A1 | 4/2008 |
| WO | 2014091228 | A1 | 6/2014 |

OTHER PUBLICATIONS

International Preliminary Report on Patentability and Written Opinion received for Patent Application No. PCT/GB2013/053259, mailed on Jun. 25, 2015. 10 pages.

(Continued)

*Primary Examiner* — Jean B Jeanglaude
(74) *Attorney, Agent, or Firm* — Finch & Maloney PLLC

(57) ABSTRACT

An antenna sub-array for use in an antenna array having a plurality of such sub-arrays includes a stripline for signal distribution, the stripline defining a plurality of signal pathways from a common feed point to a plurality of radiating elements, wherein the stripline is housed in a first support structure located a distance away from a first surface of a ground plane structure.

20 Claims, 5 Drawing Sheets

(58) Field of Classification Search
USPC ..... 343/853, 770
See application file for complete search history.

(56) References Cited

U.S. PATENT DOCUMENTS

| | | | | |
|---|---|---|---|---|
| 5,302,959 | A | 4/1994 | Harrington et al. | |
| 5,337,065 | A * | 8/1994 | Bonnet | H01Q 21/0081 343/700 MS |
| 5,917,456 | A | 6/1999 | Teunisse | |
| 6,239,764 | B1 | 5/2001 | Timofeev et al. | |
| 7,114,958 | B2 * | 10/2006 | Angelucci | H01Q 1/1207 439/108 |
| 7,183,995 | B2 * | 2/2007 | Pleva | G01S 7/032 342/374 |
| 2004/0021613 | A1 | 2/2004 | Nesic et al. | |
| 2006/0055613 | A1 * | 3/2006 | Angelucci | H01Q 1/1207 343/770 |
| 2007/0279303 | A1 | 12/2007 | Schoebel | |
| 2008/0106482 | A1 | 5/2008 | Cherrette et al. | |

OTHER PUBLICATIONS

International Search Report received for Patent Application No. PCT/GB2013/053259, mailed on Mar. 6, 2014. 6 pages.
GB Intellectual Property Office Search Report under Section 17(5) received for GB Patent Application No. 1222600.7 mailed Apr. 11, 2013. 5 pages.
Partial European Search Report received for EP Patent Application No. 12275204.1, mailed May 7, 2013. 5 pages.

* cited by examiner

ANTENNAS

FIELD

The present invention relates to the field of antennas, particularly antenna for use in Radar systems. It finds particular, but not exclusive utility in the field of marine Radar systems i.e. those installed on ships.

BACKGROUND TO THE PRESENT INVENTION

Most or many ships are equipped with at least one Radar system, used for navigation and/or other purposes. In particular, military vessels are frequently equipped with a weapons system Radar which is provided to locate, identify and possibly track possible threats. The complexity and functionality of such a weapons system Radar is far greater than that of a relatively simple navigational Radar system.

In typical prior art systems, the Radar antenna rotates to sweep signals across the location and is affixed to an upper portion of a high mast on the vessel. It is desirable to position the antenna as high as possible to give optimal range coverage and to avoid any other parts of the vessel from obscuring the transmit or receive Radar signal.

A problem with such an arrangement is that the antenna typically has a mass of several hundred kilograms. The mass of the system is due to prior art antennas incorporating a good deal of the Radio Frequency (RF) equipment within the antenna housing. Typically, this RF equipment includes one or more of transmitters, receivers, duplexers, filters and associated processing equipment.

The signals from the RF equipment are passed to digital processing systems, using one or more complex rotating joints which allow electrical continuity between the rotating antenna housing and the connected circuits.

Having a large, heavy rotating mass situated atop a mast, often at the highest point of the vessel, poses problems—not least in terms of stability, installation and maintenance—and there is a general desire to reduce the mass of the rotating part of the Radar system as far as possible. Prior art techniques have tended to concentrate on designing out as much mass from the RF equipment and housing, but there is a limit to how much mass can be eliminated from the antenna housing by these means.

Embodiments of the present invention aim to address these and other problems with prior art Radar antennas, whether mentioned herein or not.

SUMMARY OF THE INVENTION

According to an aspect of the present invention, there is provided an antenna sub-array for use in an antenna array comprising a plurality of such sub-arrays, comprising: a stripline for signal distribution, the stripline defining a plurality of signal pathways from a common feed point to a plurality of radiating elements, wherein the stripline is housed in a first support structure located a distance away from a first surface of a ground plane structure.

Preferably, the first support structure comprises a foam material having predefined dielectric properties.

Preferably, the predefined dielectric properties include having a dielectric constant substantially equal to that of air.

Preferably, the stripline is located in a channel in the first support structure and held in position above the first surface of the ground plane structure by a button formed from the same material as the first support structure.

Preferably, affixed to a second surface of the ground plane structure is a second support structure.

Preferably the first and second support structures are different materials.

Preferably, the stripline and the radiating elements are integrally formed.

Preferably, the first support structure comprises a plurality of channels arranged to receive a cooling fluid for cooling the stripline and radiating elements.

According to a further aspect of the present invention, there is provided an antenna array comprising a plurality of sub-arrays according to the first aspect.

According to a still further aspect of the present invention, there is provided a method of manufacturing an antenna array, comprising the steps of: providing a plurality of sub-arrays, each according to the first aspect; assembling the plurality of sub-arrays in a layered arrangement and securing each sub-array to a neighbouring sub-array with an adhesive substance; curing said adhesive to form a unitary antenna array.

According to a still further aspect of the present invention, there is provided a method of cooling an antenna sub-array, according to the first aspect, comprising the steps of: providing a channel in a portion of the sub-array, said channel housing at least some Radio Frequency components; and forcing a cooling fluid into the channel via a first aperture, such that the cooling fluid passes through the channel and is exhausted at a second aperture.

Preferably, the first aperture is proximal to a Radio Frequency connector of the sub-array.

Preferably, the second aperture is proximal to one or more of the plurality of radiating elements.

Preferably the channel is provided in the first support structure, which houses the stripline.

BRIEF DESCRIPTION OF THE FIGURES

For a better understanding of the invention, and to show how embodiments of the same may be carried into effect, reference will now be made, by way of example, to the accompanying diagrammatic drawings in which.

DETAILED DESCRIPTION OF PREFERRED EMBODIMENT

Embodiments of the present invention allow an antenna array, for use with a Radar system, to be constructed from a plurality of individual sub-arrays. The sub arrays are substantially identical. This provides a great deal of design freedom, and allows antenna arrays having different functional properties to be created, starting from a single building block, namely the sub-array.

The sub-array is arranged to be lightweight and, as such, is constructed, as far as possible, from lightweight foam materials, which are used to support and house the feed and radiating components, which carry and transmit the RF signals, respectively.

At the frequencies used in Radar systems, stripline techniques are often used to carry and distribute the signals from transmitters and/or receivers to individual radiating elements, which are arranged to co-operate to produce a desired antenna performance. Details of the stripline construction and its housing will follow shortly.

Figure 1A:
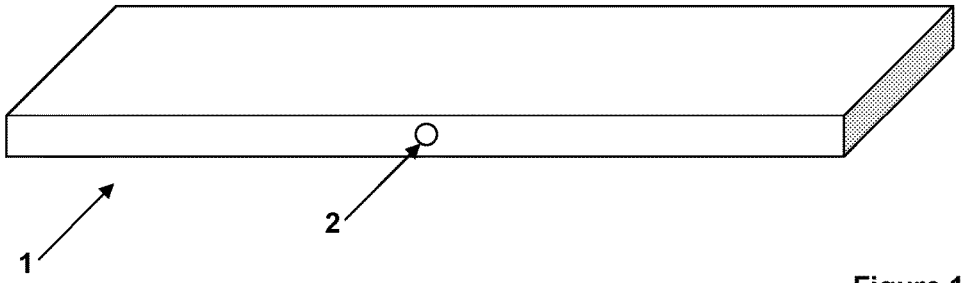
FIGS. 1*a* and 1*b* show rear and front views, respectively, of an antenna sub-array according to an embodiment of the present invention.

FIG. 1*a* shows a rear perspective view of an antenna sub-array 1 according to an embodiment of the present invention. The sub-array in this embodiment is formed to have a substantially rectangular profile in plan view. In terms of its dimensions, it is significantly larger in width and depth than height, although other configurations are possible where this may not be the case.

On its rear surface, as shown in FIG. 1*a*, there is provided an RF connector 2 which forms a common feed point for connection of the sub-array 1 to the RF equipment (not shown). The RF connector may be an N-type coaxial connector or any other suitable form of connector.

Figure 1B:
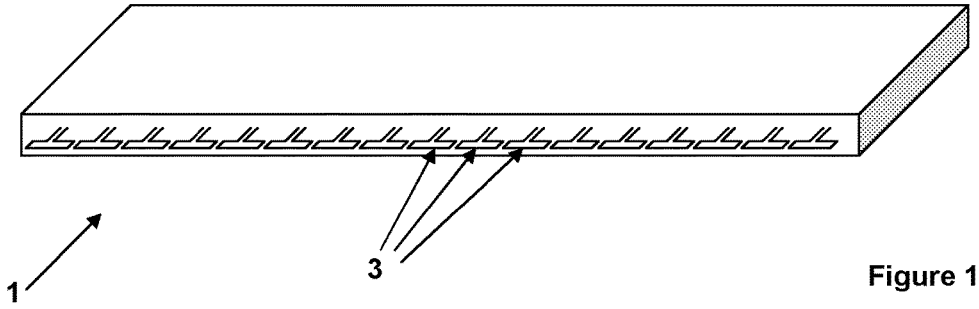

On the front surface, as shown in FIG. 1*b*, there is provided a plurality of individual radiating elements 3. In the present embodiment, these take the form of identical dipole elements. In alternative embodiments, the individual radiating elements may not be identical and may not be dipole elements, but different forms of antenna.

The dipole elements 3 are integrally formed with the stripline, meaning that the feed structure and the radiating structure are part of the same physical entity, having been milled from the same sheet of material. This has advantages in ease of manufacture and helps to ensure reliable antenna performance. However, in alternative embodiments, the individual radiating elements may be connected to the stripline feed structure by respective individual connectors.

Figure 2:
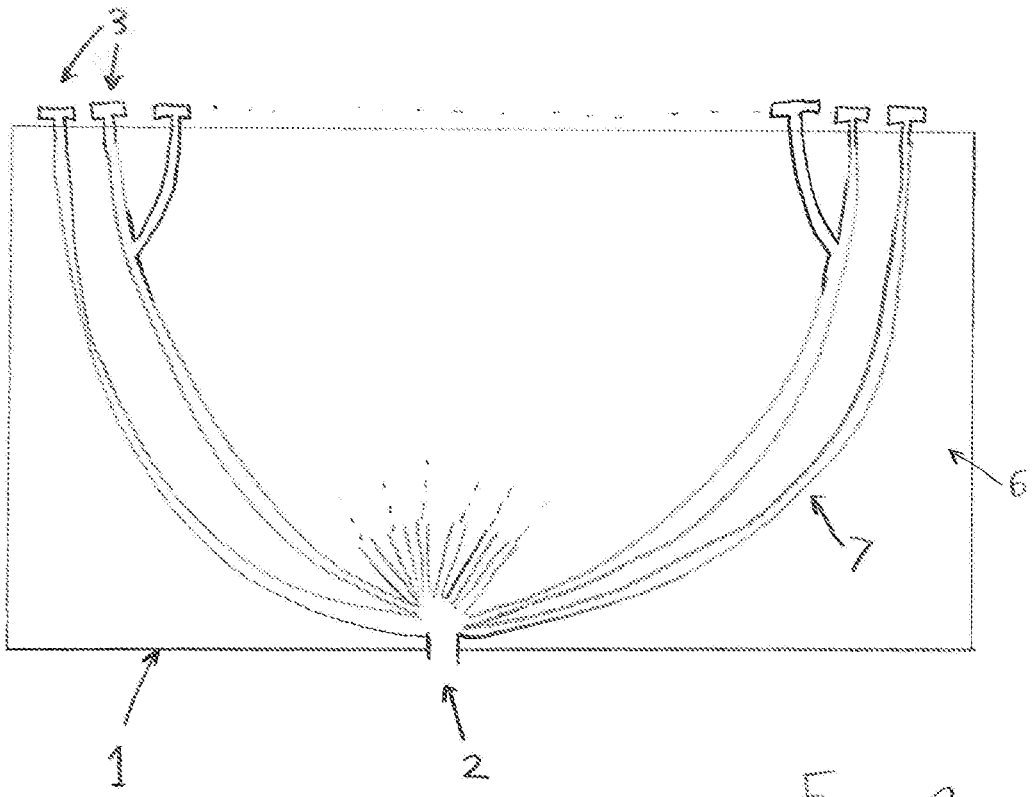
FIG. 2 shows a plan view of a stripline in a sub-array according to an embodiment of the present invention.

FIG. 2 shows a typical stripline 7 layout. The stripline is milled from sheet aluminium to precise tolerances and, as far as is practicable, from a single sheet of material. The path length of any particular branch is calculated to achieve a particular phase relationship between each respective path. For instance, in most cases, it will be desired to ensure that each individual path length is identical and so certain of the individual branches may meander or deviate to achieve this. The exact nature of this meandering not shown here, and will depend on the specification of the antenna sub-array.

Figure 3:
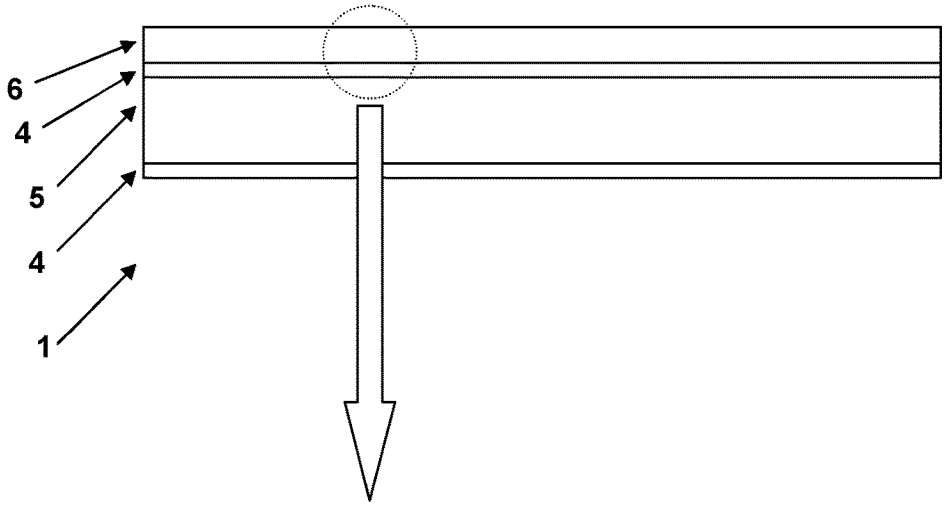
FIG. 3 shows a cross-section through a sub-array according to an embodiment of the present invention.
Figure 3:
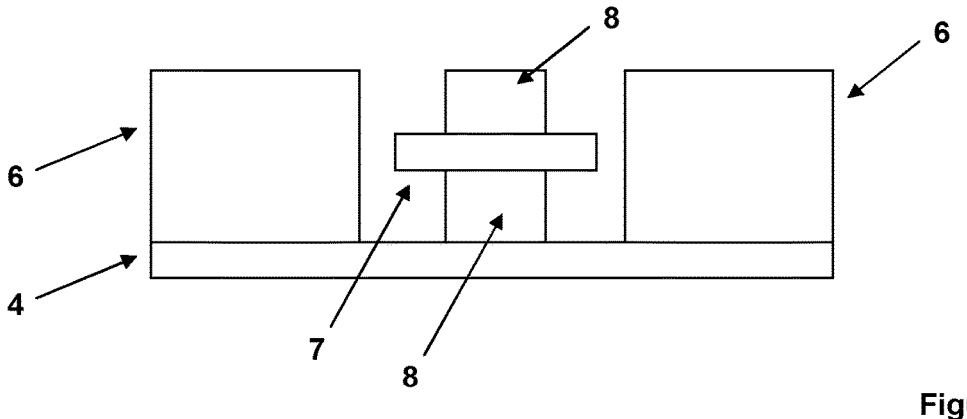

The stripline 7 is accommodated as shown in FIG. 3 which shows a cross-sectional view through a sub-array 1. On a lower surface of the sub-array, there is a ground plane 4. This is formed from aluminium 1200 foil, 0.2 mm thick which is secured to a layer of structural foam 5, by means of a lightweight adhesive film (such as SA70/100 g adhesive film). The structural foam 5 provides strength and form to the sub-array. It is chosen to have specified mechanical properties and to be as lightweight as possible, while still providing the required strength and structure. A suitable lightweight structural foam material is ROHACELL 31 IG, a polymethacrylimide foam, available from Evonik industries (www.evonik.com).

Secured to the upper surface of the structural foam 5, is a further ground plane 4, identical to the one secured to the lower surface of the structural foam 5.

Secured to the upper ground plane 4 is a layer of dielectric foam 6. This is so-called as this layer of foam has specific dielectric properties, which have an influence on the properties of the stripline 7. Specifically, the dielectric foam 6 is selected to have a dielectric constant as near as possible to that of free air. A suitable dielectric foam is ROHACELL 31HF, a polymethacrylimide foam, also available from Evonik Industries. In other embodiments, the dielectric foam may be selected to have a dielectric constant which is significantly different to that of free air to achieve different transmission effects.

The same adhesive film, which is used to secure the lower ground plane 4 to the structural foam 5, is used to secure the other parts of the sub-array together i.e. it is located between structural foam 5 an upper ground plane 4, and also between upper ground plane 4 and dielectric foam 6. It is also used to secure each individual sub array to its neighbouring sub-array when the complete array is constructed, as will be described shortly.

The dielectric foam 6 has channels cut into it which conform generally to the arrangement of the stripline 7, such that the stripline 7 can be accommodated in the channels and within the thickness of the dielectric foam 6. This is illustrated in the detailed view of FIG. 3 where a channel in the dielectric foam can be seen, in which is situated the stripline 7. It is supported above the lower ground plane 4 by a button 8 of dielectric foam. There is a similar or identical button 8 positioned above the lower button so that the stripline 7 is effectively sandwiched into position and so can maintain a constant distance between the upper and lower ground planes 4, for its entire length. This is important in ensuring proper operation of the stripline in feeding RF signals to the antenna elements 3.

The antenna elements 3 are arranged to protrude from beyond the front surface of the sub-array 1.

Figure 4:
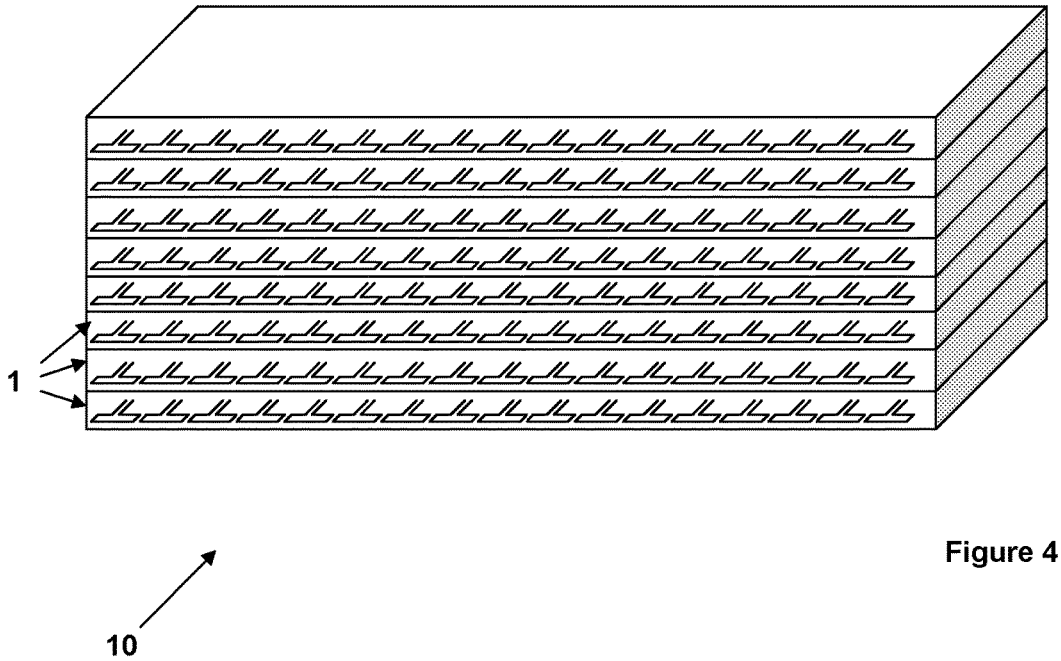
FIG. 4 shows an front view of an antenna array according to an embodiment of the present invention comprising a plurality of sub-arrays.

In order to create an antenna array 10 for use in a Radar system, a plurality of individual sub-arrays 1 are coupled together, as shown in FIG. 4. In this way, the lower ground plane 4 of a first sub-array, when placed atop another sub-array, completes the stripline circuit, by enclosing the stripline 7 between two ground planes.

In order to complete the stripline circuit for the uppermost sub-array, a ground plane 4 is affixed atop the dielectric foam 6. A further layer of structural foam 5 may be provided at the very top of the array to protect the stripline 7 disposed within the uppermost sub-array.

Once the required number of sub-arrays have been assembled, as shown in FIG. 4, with an adhesive film being used to couple the various layers together, the entire assembly is cured to form a single unit which is then treated as a single unitary part, since it may not be disassembled without damaging the components contained therein.

The curing process involves placing the complete array assembly in an oven at 80° C. Thermocouples may be provided at various points of the array to ensure that the core temperature is maintained at the correct level. Then the array is allowed to cool, during which time it is found that the height of the array assembly reduces by a few millimeters, typically. However, after about 2 weeks, the height is recovered.

The selected adhesive film having 100 g per square meter weight profile ensures that the amount of adhesive in the assembly is a known controlled quantity and allows the stripline and ground plane 4 to interact correctly.

The number of sub-arrays 1 required to form the antenna array 10 is determined by the performance requirements of the finished antenna array. Using beam-forming techniques, which are know in the field of Radar design, the beams formed by the respective sub-arrays 1 can be made to co-operate to give a desired performance. If a lesser degree of performance is required, then fewer sub-arrays can be included in the antenna array. Therefore, the modular design approach employed herein lends itself well to flexible design methodologies, where overall system requirements can be altered relatively straightforwardly.

Figure 5:
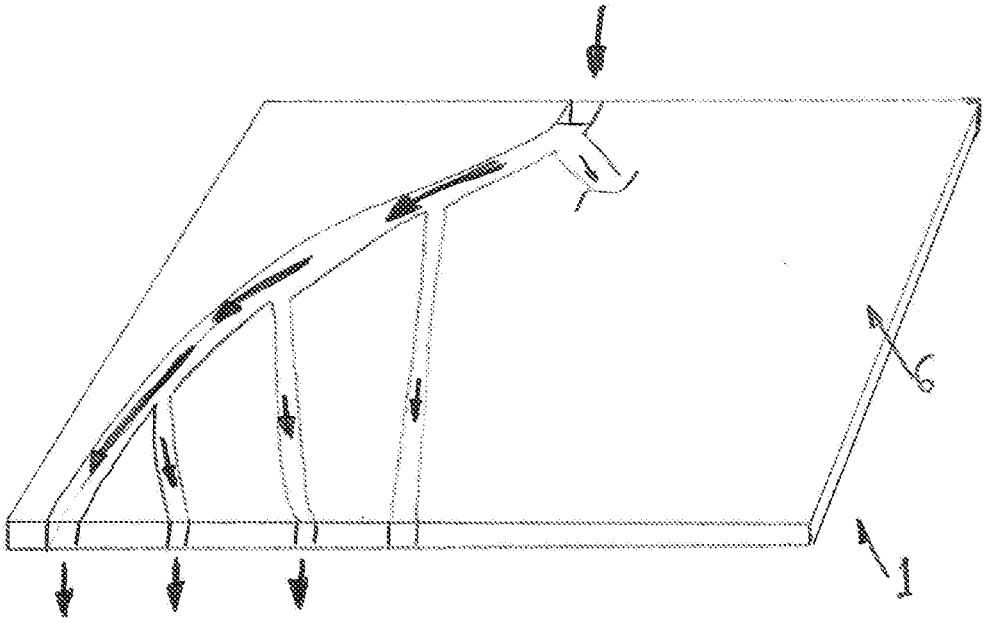
FIG. 5 shows how a cooling fluid acts to cool the stripline and antenna elements.

FIG. 5 shows how the channels formed in the dielectric foam permit a cooling to be propelled through said channels for the purposes of cooling the stripline and radiating elements (not shown in FIG. 5, for clarity). Cooled air is the preferred cooling fluid and it is injected into the sub array in the vicinity of the connector 2. The cooled air flows through the channels in which the stripline 7 is housed, and exits the sub-array in the vicinity of the radiating elements 3, having cooled the parts it has contacted along its way. The now warmer air is expelled from the antenna housing in a continuous flow.

The buttons 8 which support the stripline and maintain its position between the upper and lower ground planes are dimensioned to ensure that air can pass through the channels relatively unimpeded. Given the branching nature of the channels, cooling fluid injected at a common point, flows along each channel and cools all parts of the antenna array. The cooling fluid essentially follows the same path as the stripline 7.

By use of the materials and construction techniques disclosed herein, antenna arrays of significantly lower mass than prior art antennas can be constructed. Furthermore, by making use of a plurality of identical sub-arrays, different overall antenna characteristics and specification can be achieved, without re-designing the entire antenna. Instead, the desired performance may be achieved by use of an appropriate number of sub-arrays.

Embodiments of the present invention are able to meet stringent weight requirements by use of composite manufacturing techniques, which are believed not to have been used in antenna manufacture before.

There are no mechanical fixings used in the entire completed array structure, which helps to keep the weight down and reduces possible points of failure. Indeed, the competed array is maintenance free and is considered as a single unit once the manufacturing process is complete.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An antenna sub-array for use in an antenna array comprising a plurality of such sub-arrays, the antenna sub-array comprising:

a first ground plane;

a stripline for signal distribution, the stripline defining a plurality of signal pathways from a common feed point to a plurality of radiating elements, wherein the stripline is housed in a first support structure on a first surface of the first ground plane, said first support structure including a dielectric foam material, said dielectric foam material including a plurality of channels arranged to receive a cooling fluid for cooling the stripline and the radiating elements.

2. An antenna array comprising a plurality of antenna sub-arrays, each according to claim 1.

3. The antenna sub-array as claimed in claim 1, wherein the dielectric foam material has a dielectric constant substantially equal to that of air.

4. The antenna sub-array as claimed in claim 1, wherein the stripline is at least partially located within the channels and held in position above the first surface of the first ground plane by a button formed from a same material as the first support structure, the button located on the first support structure.

5. The antenna sub-array as claimed in claim 1, wherein a second support structure is affixed to a second surface of the first ground plane.

6. The antenna sub-array as claimed in claim 5, wherein the first and second support structures are different materials.

7. The antenna sub-array as claimed in claim 5, wherein the second support structure includes a plurality of channels arranged to receive the cooling fluid for cooling the stripline and the radiating elements.

8. The antenna sub-array as claimed in claim 1, wherein the cooling fluid is a liquid for cooling the stripline and the radiating elements.

9. The antenna sub-array as claimed in claim 1, wherein the stripline and the radiating elements are integrally formed.

10. The antenna sub-array as claimed in claim 1, further comprising a second ground plane separated from a second surface of the first ground plane by a second support structure, said second support structure including a structural foam.

11. The antenna sub-array as claimed in claim 10, wherein the second support structure is affixed to the second surface of the first ground plane.

12. The antenna sub-array as claimed in claim 10, further comprising a first button formed from the first support structure, and a second button formed from the second support structure, wherein the stripline is at least partially located within the channels and held in position above the first ground plane by the first button and further held in position below the second ground plane by the second button such that the stripline is sandwiched between the first ground plane and the second ground plane by the first button and the second button.

13. The antenna sub-array as claimed in claim 10, wherein the second support structure includes a plurality of channels arranged to receive the cooling fluid for cooling the stripline and the radiating elements.

14. The antenna sub-array as claimed in claim 1, wherein the stripline is located within the channels and held in position above the first surface of the first ground plane by a button formed from the dielectric foam material.

15. The antenna sub-array of claim 1, further comprising a first aperture proximal to a Radio Frequency connector of the antenna sub-array for receiving the cooling fluid.

16. The antenna sub-array of claim 15, further comprising a second aperture proximal to one or more of the plurality of radiating elements for exhausting the cooling fluid.

17. A method of manufacturing an antenna array, the method comprising:

providing a plurality of antenna sub-arrays;

assembling the plurality of antenna sub-arrays in a layered arrangement and securing each antenna sub-array to a neighbouring antenna sub-array with an adhesive substance; and curing said adhesive to form a unitary antenna array, wherein each of the antenna sub-arrays includes a first ground plane and a stripline for signal distribution, the stripline defining a plurality of signal pathways from a common feed point to a plurality of radiating elements, wherein the stripline is housed in a first support structure on a first surface of the first ground plane, said first support structure including a dielectric foam material, said dielectric foam material including a plurality of channels arranged to receive a cooling fluid for cooling the stripline and the radiating elements.

18. A method of cooling an antenna sub-array, the antenna sub-array including a first ground plane and a stripline for signal distribution, the stripline defining a plurality of signal pathways from a common feed point to a plurality of radiating elements, wherein the stripline is housed in a first support structure on a first surface of the first ground plane, said first support structure including a dielectric foam material, said dielectric foam material including a plurality of channels arranged to receive a cooling fluid for cooling the stripline and the radiating elements, the method comprising:

forcing a cooling fluid into the channels via a first aperture, such that the cooling fluid passes through the channels and is exhausted at a second aperture.

19. The method of claim 18, wherein the first aperture is proximal to a Radio Frequency connector of the antenna sub-array.

20. The method of claim 18, wherein the second aperture is proximal to one or more of the plurality of radiating elements.

* * * * *